US005293507A

United States Patent [19]

Hayakawa

[11] Patent Number: 5,293,507

[45] Date of Patent: Mar. 8, 1994

[54] MOVABLE CONTACT PIECE SUPPORT STRUCTURE OF A SEESAW SWITCH

[75] Inventor: Hiroshi Hayakawa, Furukawa, Japan

[73] Assignee: Alps Electric Co., Ltd., Tokyo, Japan

[21] Appl. No.: 839,190

[22] Filed: Feb. 20, 1992

[30] Foreign Application Priority Data

Feb. 22, 1991 [JP] Japan ..... 3-14518[U]

[51] Int. Cl.[5] ..... H01H 1/22

[52] U.S. Cl. ..... 200/244; 200/553; 200/275; 200/6 B

[58] Field of Search ..... 200/553, 554, 555, 561, 200/562, 563, 244, 245, 238, 239, 434, 437, 452, 465, 6 R, 6 B, 6 A, 6 BA, 6 BB, 275, 339

[56] References Cited

U.S. PATENT DOCUMENTS

| | | | |
|---|---|---|---|
| 1,918,282 | 7/1933 | Meuer | 200/437 X |
| 2,027,538 | 1/1936 | Kreiger | 200/437 |
| 3,688,062 | 8/1972 | Yamamoto et al. | 200/437 |
| 3,746,359 | 7/1973 | Lewis | 200/437 |
| 4,068,107 | 1/1978 | Key | 200/437 |
| 4,408,105 | 10/1983 | Tanaka | 200/244 X |
| 4,524,253 | 6/1985 | Swenson | 200/6 BA |
| 4,803,317 | 2/1989 | Sutoh et al. | 200/339 X |
| 4,814,554 | 3/1989 | Magiera | 200/437 X |

FOREIGN PATENT DOCUMENTS

| | | | |
|---|---|---|---|
| 1070726 | 12/1959 | Fed. Rep. of Germany | 200/437 |

*Primary Examiner*—Glenn T. Barrett

*Attorney, Agent, or Firm*—Guy W. Shoup; David W. Heid; Patrick T. Bever

[57] ABSTRACT

A movable contact piece support structure for a seesaw switch including guide portions formed in walls of the seesaw switch and slits formed by cutting the movable contact piece and bending back a pair of flaps to make a pair of bent portions. The size and shape of the guide portions and the angle at which the bent portions are bent are chosen so that the movable contact piece rests on the guide portions and on a central contact with the bent portions in contact with the guide portions. The guide portions are further shaped such that bent portions slide smoothly on the guide portions as the movable contact piece rocks back and forth between on and off positions of the seesaw switch.

3 Claims, 5 Drawing Sheets

MOVABLE CONTACT PIECE SUPPORT STRUCTURE OF A SEESAW SWITCH

BACKGROUND OF THE INVENTION

1. Field of the Invention

The present invention relates to the support structure for a movable contact piece of a seesaw switch which performs a switching operation by rocking the movable contact piece.

2. Description of the Related Art

A seesaw switch which performs a switching operation by rocking a movable contact piece is widely used as a power window switch or a power seat switch of an automobile and so on. FIGS. 6 and 7 illustrate the support structures of the movable contact pieces in conventional seesaw switches. A movable contact piece 1 shown in FIG. 6 is bent at its center and symmetrically formed in the shape of the letter V. One of inclined portions 1*a* of the movable contact piece 1 is formed with slits 2. On the other hand, a guide strip 3 is provided to project upward from an inside bottom of a case of the switch. A slit 5*a* having a width longer than the distance between the slits 2 of the movable contact piece 1 is formed by press working in the center of the leading end of the guide strip 3, and projections 5*b* and 5*b* are formed on both ends of the leading end of the guide strip 3 by the slit 5*a*. In the seesaw switch having the support structure shown in FIG. 6, the movable contact piece 1 rocks on the leading end of the guide strip 3 serving as a fulcrum while the projections 5*b* of the guide strip 3 are engaged with the slits 2 of the movable contact piece 1, respectively. The movable contact piece 1 is positioned in its longitudinal direction by the engagement of the slits 2 and 2 and the projections 5*b*, and a switching operation is performed by the contacting and separation of an unillustrated fixed contact and the movable contact piece 1.

In the support structure of a movable contact piece 1 shown in FIG. 7, engaging strips 6 extend from both sides in the center of the movable contact piece 1 to project outward. On the other hand, concave portions 8 are formed on both side walls 7 of the case of the switch. As shown in FIG. 7, while the engaging strips 6 of the movable contact piece 1 are fitted in the concave portions 8 on the side walls 7 and the movable contact piece 1 is positioned in its longitudinal direction, the movable contact piece 1 rocks on a central terminal 10 which projects deviating slightly from the center of the movable contact piece 1, and a switching operation is performed by the contacting and separation of an unillustrated fixed contact and the movable contact piece 1.

The structures of the movable contact pieces 1 shown in FIGS. 6 and 7 are formed by press working. Slits 2, slit 5*a*, and engaging strips 6 are formed by breaking out sections of material. The slide between the slits 2 of the movable contact piece 1 and the slit 5*a* of the guide strip 3, or the slide between the engaging strips 6 of the movable contact piece 1 and the concave portions 8 of the side walls 7 is performed through broken-out sections formed by press working. Burrs on the broken-out section may prevent the slide from being stably performed, resulting in unstable rocking. Furthermore, the burrs also cause abrasions, and thus there is a problem with respect to the durability of the switch.

SUMMARY OF THE INVENTION

An object of the present invention is to provide a movable contact piece support structure of a seesaw switch which is capable of being efficiently produced in an automatic assembly process, and of realizing a stable switching operation by smoothly sliding engaging strips and guide concave portions when a movable contact piece is rocked.

In order to achieve the above object, there is provided a movable contact piece support structure of a seesaw switch having a central terminal, at least one fixed contact, a movable contact piece for rocking on the central terminal serving as a fulcrum in order that the movable contact piece will be brought into contact with and separated from the fixed contact and a drive member for rocking the movable contact piece, in which slits are formed by cutting both ends in the center of the movable contact piece, a pair of bent portions are formed by bending the cut portions in the opposite directions, regulating convex portions for regulating the movement of the drive member of the contact piece in the rocking direction by engaging the slits are mounted, and opposite faces of the pair of bent portions of the slits are in contact with the regulating convex portions so as to put the regulating convex portions therebetween.

According to the above construction, the bent portions can be easily formed by cutting bending processes, and the bent portions slide while their broken-out sections are not in contact with the guide convex portions, and the movable contact piece is guided by the guide convex portions when being positioned in the longitudinal direction. Therefore, it is possible to perform a smooth rocking movement and a stable slide movement.

DESCRIPTION OF THE PREFERRED EMBODIMENT

Figure 1:
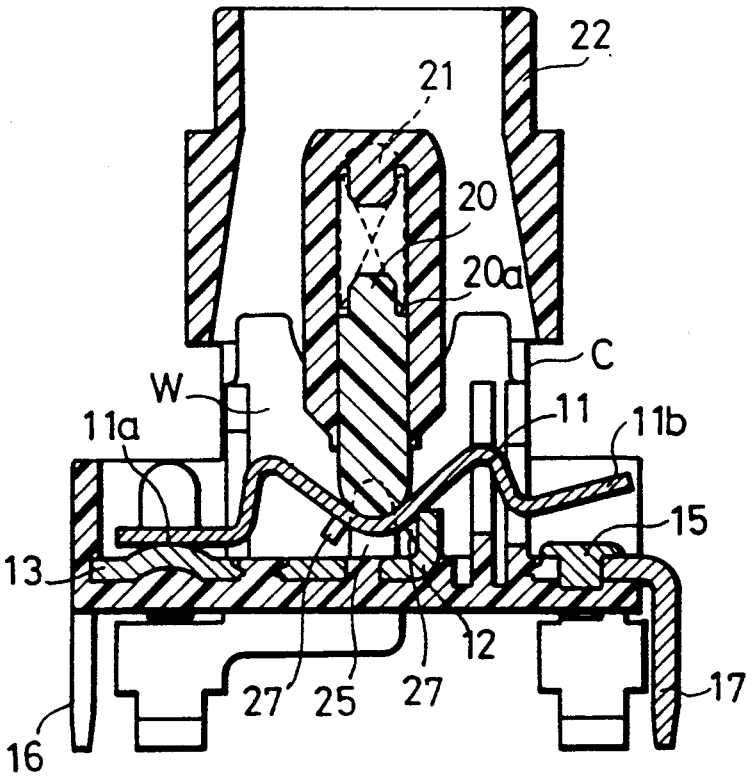
FIG. 1 is an explanatory view showing a neutral state of a seesaw switch according to an embodiment of the present invention.
Figure 2:
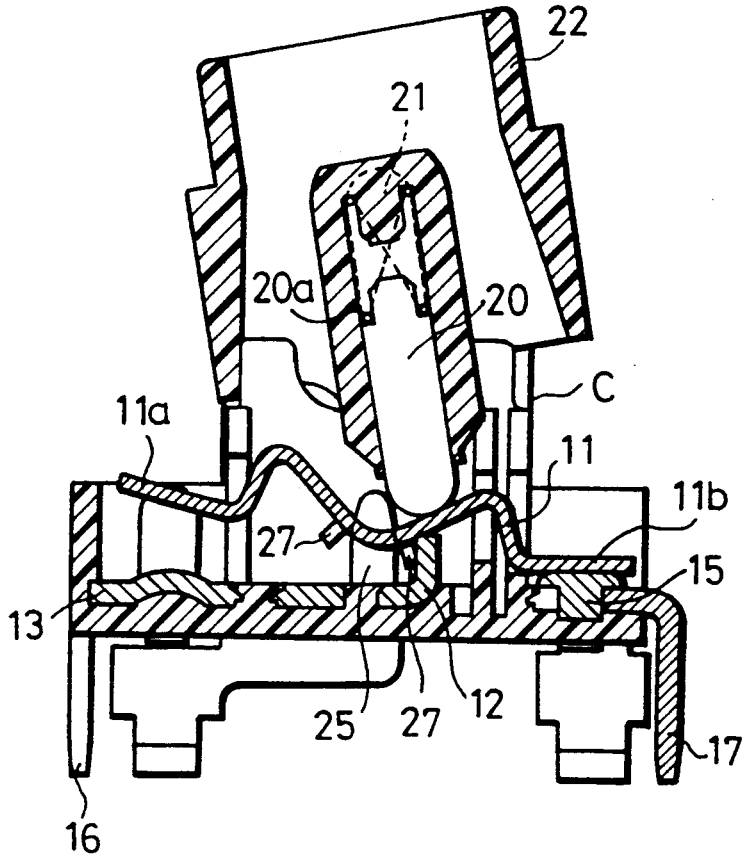
FIG. 2 is an explanatory view showing a switching state of the seesaw switch.

An embodiment of the present invention will now be described with reference to FIGS. 1 to 5. FIG. 1 is an explanatory view showing a neutral state of a seesaw switch, FIG. 2 is an explanatory view showing a switching state of the seesaw switch, FIG. 3 is a top view of the seesaw switch, FIG. 4 is an explanatory view cutting away a drive member shown in FIG. 1, and FIG. 5 is an exploded perspective view of the principal part of the seesaw switch.

Figure 3:
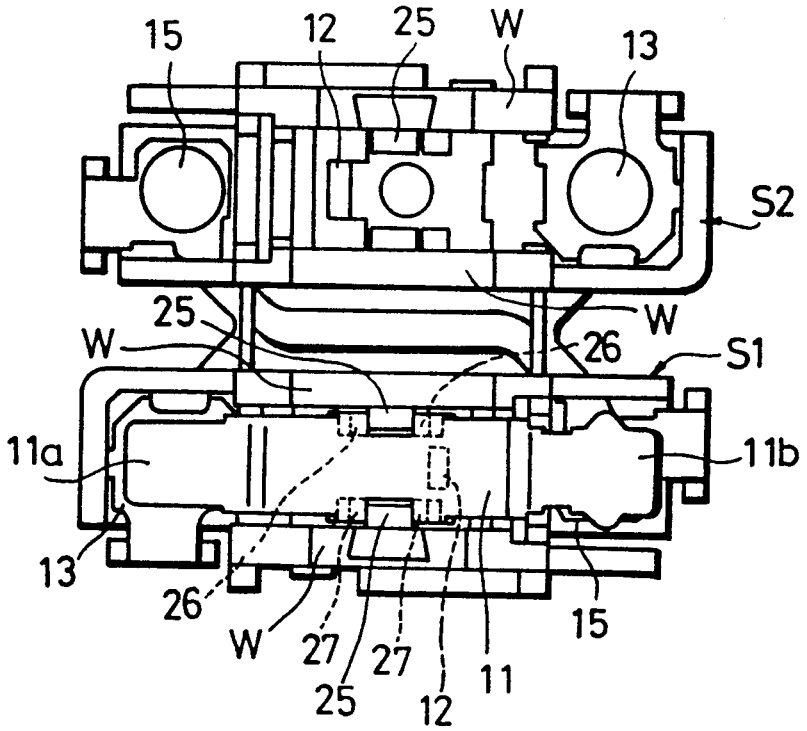
FIG. 3 is a top view of the seesaw switch.
Figure 4:
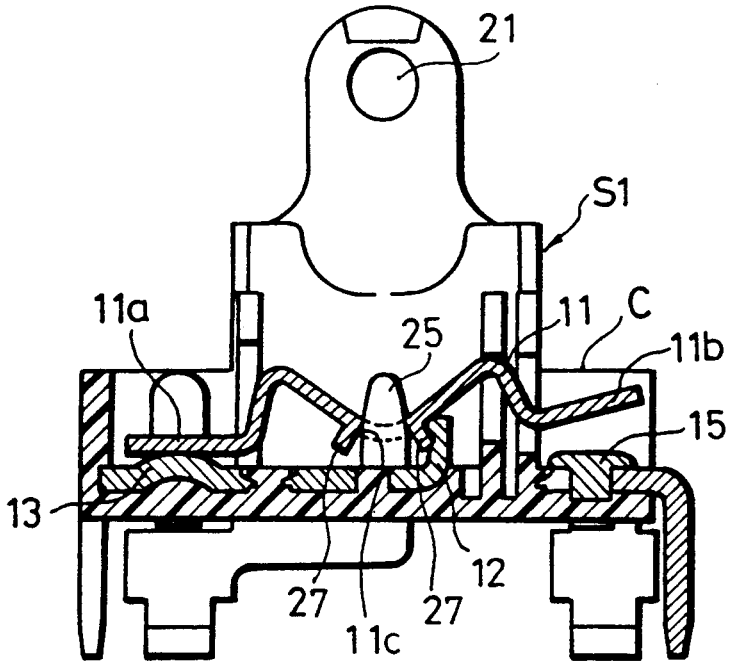
FIG. 4 is an explanatory view of the seesaw switch from which a drive member shown in FIG. 1 is cut away.

As shown in FIG. 3, a pair of seesaw switches S1 and S2 are point-symmetrically arranged as a unit to simultaneously perform switching operations, thereby forming a double switch. One of the seesaw switches S1 will be explained with reference to FIGS. 1 to 5. Referring to FIG. 1, a movable contact piece 11 having movable contacts 11*a* and 11*b* at both its ends, a central terminal 12, fixed contacts 13 and 15, and a drive member 20 are mounted in a wafer C as a component of the case of the switch S1. When a lever 22 containing the drive member 20 is moved to one side, the drive member 20 is rocked with a support portion 21 serving as a fulcrum. The drive member 20 is urged downward by a coil spring 20*a* and the bottom portion of the drive member 20 is slid on the movable contact piece 11 by the rocking movement, thereby rocking the movable contact piece 11.

The movable contact piece 11 is formed symmetrically and substantially in the shape of the letter M by press working, and made of a conductive material. The fixed contacts 13 and 15 in the wafer C opposite to the movable contacts 11*a* and 11*b* are connected to terminals 16 and 17 led outside the wafer C, respectively. The central terminal 12 is fixed at the bottom of the wafer C, and the movable contact piece 11 is mounted rotatably on the central terminal 12 on the wafer C.

Figure 5:
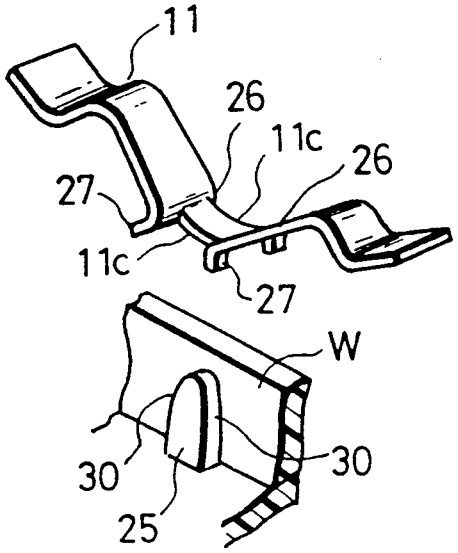
FIG. 5 is an exploded perspective view of the principal part of the seesaw switch.
Figure 6:
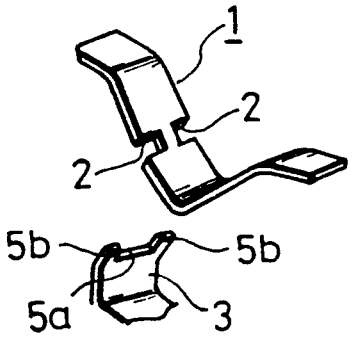
Fig. 6 PRIOR ART
FIG. 6 is an explanatory view of a movable contact piece support structure of a conventional seesaw switch.
Figure 7:
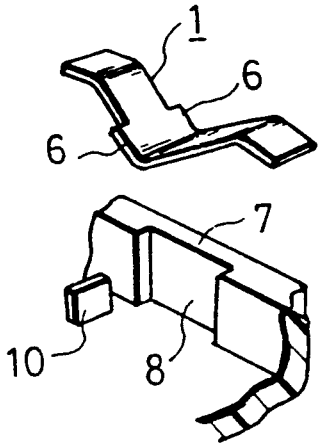
Fig. 7 PRIOR ART
FIG. 7 is an explanatory view of a movable contact piece support structure of another conventional seesaw switch.

As shown in FIG. 5, slits 11*c* are formed along both sides in the center of the movable contact piece 11 by bending pairs of bent portions 26 and 27 in the opposite directions by approximately 90°. A pair of guide convex portions 25 project inside side walls W of the wafer C opposite to the bent portions 26 and 27. Predetermined inclined faces 30 are formed by making the top faces of the guide convex portions 25 round. The bent portions 26 engage both of the inclined faces 30 of the guide convex portion 25 inside one of the opposite side walls W, and the bent portions 27 engage both of the inclined faces 30 of the guide convex portion 25 inside the other side wall W. In this state, the movable contact piece 11 is disposed rockably on the leading end of the central terminal 12 at the bottom of the wafer C. The shape of the side faces of the guide convex portions 25 and the bending angle of the bent portions 26 and 27 are set so that the movable contact piece 1 can stably and smoothly move within a rotation angle range where switching operations are performed.

As shown in FIG. 3, the seesaw switches S1 and S2 are assembled as a unit back to back and switching operations of both switches S1 and S2 are performed by the single lever 22. FIG. 4 shows the seesaw switch S1 from which the lever 22 and the drive member 20 are removed. The bent portions 26 and 27 are engaged with the guide convex portions 25 in the wafer C and thus the movable contact 11*a* of the movable contact piece 11 is in contact with the fixed contact 13. Therefore, in one of the seesaw switches S1, the fixed contact 13 and the movable contact 11*a* are in contact and the fixed contact 15 and the movable contact 11*b* are separated from each other in the neutral position of the drive member 20 shown in FIG. 1, resulting in a first switching state to turn off the seesaw switch S1. If the drive member 20 is moved toward the movable contact 11*a* by rotating the lever 22 on the support portion 21 clockwise from the state shown in FIG. 1, the movable contact 11 does not rock and the seesaw switch S1 holds the above first switching state. When the lever 22 is rotated counterclockwise on the support portion 21 and the drive portion 20 slides toward the movable contact 11*b*, the movable contact piece 11 is rotated on the central terminal 12 clockwise, the fixed contact 13 and the movable contact 11*a* are separated, and the fixed contact 15 is brought into contact with the movable contact 11*b*, resulting in a second switching state which turns on the seesaw switch S1.

The switching operation of the above embodiment will now be described. When the lever 22 is not tilted and the drive member 20 is in the neutral position as shown in FIG. 1, the seesaw switch S1 is in the first switching state where the fixed contact 15 and the movable contact 11*b* are not in contact (the fixed contact 13 and the movable contact 11*a* are in contact). At this time, the other seesaw switch S2 combined with the seesaw switch S1 back to back is similarly in the first switching state where the fixed contact 13 and the movable contact 11*a* are in contact (the fixed contact 15 and the movable contact 11*b* are not in contact). When the lever 22 is rotated clockwise on the support portion 21 from the state shown in FIG. 1, since the movable contact piece 11 does not rock, the seesaw switch S1 holds the first switching state. On the other hand, the seesaw switch S2 is simultaneously operated by the rotation of the lever 22. The movable contact piece 11 is rotated on the central terminal 12 by the slide of the drive member 20 toward the movable contact 11*b*, the movable contact 11*b* and the fixed contact 15 are brought into contact, and the movable contact 11*a* and the fixed contact 13 are separated, thereby switching the seesaw switch S2 over to the second switching state. For example, in the case of a power window switch, a motor is reversed so as to close a window glass in this state. When the lever 22 is rotated counterclockwise from the neutral state shown in FIG. 1 (the seesaw switches S1 and S2 are in the first switching state), as described above, although the seesaw switch S1 is put into the second switching state where the seesaw switch S1 is turned on, the other seesaw switch S2 remains in the first switching state. The motor rotates in the direction opposite to the above direction in response to the actuation of the seesaw switch S1 in the state shown in FIG. 2.

Although the bent portions 26 and 27 engage the corresponding guide convex portions 25 and slide on both sides of the guide convex portions 25 according to the rotation of the movable contact piece 11 about the central terminal 12 during a switching operation of the embodiment, the broken-out sections of the bent portions 26 and 27 raised from the movable contact piece 11 are not in contact with the guide convex portions 25 during the slide. Therefore, the slide is not made unstable and no abrasion is caused by the burrs of the broken-out sections, and the stability of the switching operation is prevented from being lowered. Furthermore, the shape of both side faces of the guide convex portions 25 and the bending angle of the bent portions 26 and 27 can be suitably set by a simple bending process.

According to the above embodiment, since the bent portions 26 and 27 can be easily formed by simple cutting and bending processes and the movable contact piece 11 can be mounted on the guide convex portions 25 in a fall process, the switch can be efficiently produced in an automated assembly process. Furthermore, since the bent portions 26 and 27 smoothly engage with and slide on the guide convex portions 25 during a switching operation without sliding the broken-out sections of the bent portions 26 and 27, the switching operation can be stably performed.

According to the present invention described above, it is possible to provide a movable contact piece support structure of a seesaw switch capable of being efficiently produced in an automated assembly process and of achieving a stable switching operation by smoothly sliding bent portions on guide convex portions when the movable contact piece rocks.

What is claimed is:

1. A movable contact piece support structure for a seesaw switch included in a housing comprising a bottom wall, a first side wall and a second side wall, said support structure comprising:

a central terminal formed on the bottom wall, at least one fixed contact formed on the bottom wall, a movable contact piece for rocking on said central terminal with said central terminal serving as a fulcrum, said rocking causing said movable contact to contact with and separate from said fixed contact, a drive member for rocking said movable contact piece, and a first and a second guide portion which are spaced apart from the central terminal and each other and formed on the first and second side walls, respectively, of said housing, wherein said movable contact piece includes a first and a second pair of bent portions which cooperate respectively with said first and second guide portions to guide said movable contact piece.

2. The support structure of claim 1, wherein said guide portions are convex.

3. The support structure of claim 1, wherein:

said movable contact has a first and a second slit, said first slit being cut in a first side of said movable contact piece, said second slit being cut in a side of said movable contact piece opposite to said first side;

wherein said first pair of bent portions is formed by bending portions of said movable contact adjacent to said first slit; and wherein said second pair of bent portions is formed by bending portions of said movable contact adjacent to said second slit.

* * * * *